US005509255A

United States Patent [19]

Rutledge

[11] Patent Number: 5,509,255

[45] Date of Patent: Apr. 23, 1996

[54] PRESSURE VESSEL

[76] Inventor: Arthur Rutledge, 36 Burnham Avenue, St. Albert, Alberta, Canada, T8N 0A7

[21] Appl. No.: 284,996

[22] Filed: Aug. 4, 1994

[51] Int. Cl.[6] ..... B65B 11/58

[52] U.S. Cl. ..... 53/449; 53/467; 206/522; 383/3

[58] Field of Search ..... 53/434, 449, 445, 53/467, 469, 472, 473, 474; 383/2, 3, 109, 112, 110, 108, 113, 41; 206/522, 213.1; 222/92, 105, 107, 386.5

[56] References Cited

U.S. PATENT DOCUMENTS

| | | | |
|---|---|---|---|
| 2,872,760 | 2/1959 | Meissner | 53/575 |
| 3,138,248 | 6/1964 | Abbott | 53/449 |
| 3,761,013 | 9/1973 | Schuster | 383/109 |
| 4,155,453 | 5/1979 | Ono | 383/3 |
| 4,193,518 | 3/1980 | Holmes | 222/105 |
| 4,421,150 | 12/1983 | Masters | 383/3 |
| 4,569,082 | 2/1986 | Ainsworth et al. | 206/522 |
| 4,640,080 | 2/1987 | Wright | 53/449 |
| 4,869,398 | 9/1989 | Colvin et al. | 222/105 |
| 5,035,104 | 7/1991 | Helling et al. | 53/445 |
| 5,041,046 | 8/1991 | Nakamura et al. | 383/3 |
| 5,193,677 | 3/1993 | Moreno | 206/522 |
| 5,230,566 | 9/1993 | Jackson et al. | 383/41 |
| 5,358,142 | 10/1994 | Holmes | 222/105 |

*Primary Examiner*—John Sipos
*Assistant Examiner*—Ed Tolan
*Attorney, Agent, or Firm*—Anthony R. Lambert

[57] ABSTRACT

A pressure vessel is described which includes a flexible, air permeable, liquid permeable, containment envelope having an interior cavity and an access opening closed by a closure. A flexible, air tight, liquid impervious, inner bladder is provided having an interior cavity and an access opening sealed by a closure. The inner bladder is disposed within the interior cavity of the containment envelope. The containment envelope is dimensionally stable at the maximum intended pressures. The inner bladder in a fully expanded condition is larger than the containment envelope such that internal pressure acts upon the inner bladder to place the inner bladder in compression within the interior cavity of the containment envelope while placing the containment envelope in tension. The pressure vessel, as described, can be made from low cost materials such as a sealable polymer plastic bag and an envelope of spun bonded olefin material.

5 Claims, 3 Drawing Sheets

PRESSURE VESSEL

BACKGROUND OF THE INVENTION

The nations of the world are adopting international standards relating to packaging of dangerous goods for transportation, at the urging of organizations such as the International Air Transport Association (IATA). These international standards under the International Civil Aviation Organization (ICAO) require that the dangerous goods be contained within a pressure vessel. A pressure vessel that represents the state of the art is U.S. Pat. No. 5,167,344 which issued to Saf-T-Pak Inc. in December of 1992. This pressure vessel is a polymer plastic container that has an annular collar that extends outwardly and downwardly from sidewalls adjacent a top rim. The annular collar has a threaded exterior surface to which a closure lid with mating threads is secured. The threaded connection, as described, is insulated from inward and outward flexing of the sidewalls of the container which invariably results when the container is exposed to differentials in pressure.

As diagnostic specimens may contain infectious substances, IATA has indicated that all diagnostic specimens should be treated as dangerous goods and transported within a pressure vessel. The cost of complying with ICAO regulations with existing polymer plastic containers is prohibitive. The number of diagnostic specimens transported annually in the United States alone is in the billions. Some of the larger laboratories in the United States perform diagnostic testing on in excess of a quarter of a million diagnostic specimens per day.

SUMMARY OF THE INVENTION

What is required is a low cost pressure vessel.

According to the present invention there is provided a pressure vessel which includes a flexible, air permeable, liquid permeable, containment envelope having an interior cavity and an access opening closed by a closure. A flexible, air tight, liquid impervious, inner bladder is provided having an interior cavity and an access opening sealed by a closure. The inner bladder is disposed within the interior cavity of the containment envelope. The containment envelope is dimensionally stable at the maximum intended pressures. The inner bladder in a fully expanded condition is larger than the containment envelope such that internal pressure acts upon the inner bladder to place the inner bladder in compression within the interior cavity of the containment envelope while placing the containment envelope in tension.

The pressure vessel, as described above, operates in accordance with basic principles of science and can be made from low cost materials. A readily available sealable polymer plastic bag can be used for the inner bladder. These polymer plastic bags have little tensile strength, and in and of themselves can only withstand pressures of one or two pounds per square inch. However, when combined with the containment envelope, as described above, the tensile forces acting upon the polymer plastic bag are negligible. A polymer plastic bag in compression, as described above, can take considerable compression force before a failure occurs. The containment envelope is an unlikely component for a pressure vessel. It will not, in and of itself, contain any pressure for it is both air permeable and liquid permeable. The containment envelope is selected for its tensile strength. A containment envelope can be chosen to meet almost any pressure requirement. The key factor is that the containment envelope remain dimensionally stable at the maximum intended pressures. In other words, the containment envelope must not expand like a balloon. For example, a containment envelope fabricated from woven stainless steel would have tremendous tensile strength. A preferred material that can be made into envelopes much in the same fashion as paper is a spun bonded olefin material sold by Dupont Canada Inc. under the trademark TYVEK. This material has a strip tensile strength of approximately 7.9 pounds per square inch. However, when formed into an envelope, which when expanded forms a generally elliptical shape, it is capable of withstanding between 15 and 20 pounds per square inch. A quick calculation verifies that TYVEK will meet pressure requirements set forth in most, if not all, international standards relating to the transportation of diagnostic specimens. For example, a five inch by 7 inch envelope made from TYVEK has a surface area of seventy square inches. Fifteen pounds per square inch spread over a surface area of seventy square inches equates to a tensile strength able to resist over one thousands pounds of total force.

According to another aspect of the invention there is provided a method of maintaining pressure containment on dangerous goods, such as diagnostic specimens. Firstly, place dangerous goods into an interior cavity of a flexible, air tight, liquid impervious, inner bladder, and seal an access opening into the interior cavity with a closure. Secondly, place the inner bladder into an interior cavity of a flexible, air permeable, liquid permeable, containment envelope and close an access opening into the interior cavity with a closure. The containment envelope is dimensionally stable at the maximum intended pressures. The containment envelope is smaller than the inner bladder in a fully expanded condition. Upon internal pressure acting upon the inner bladder the inner bladder is placed in compression within the interior cavity of the containment envelope while placing the containment envelope in tension.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
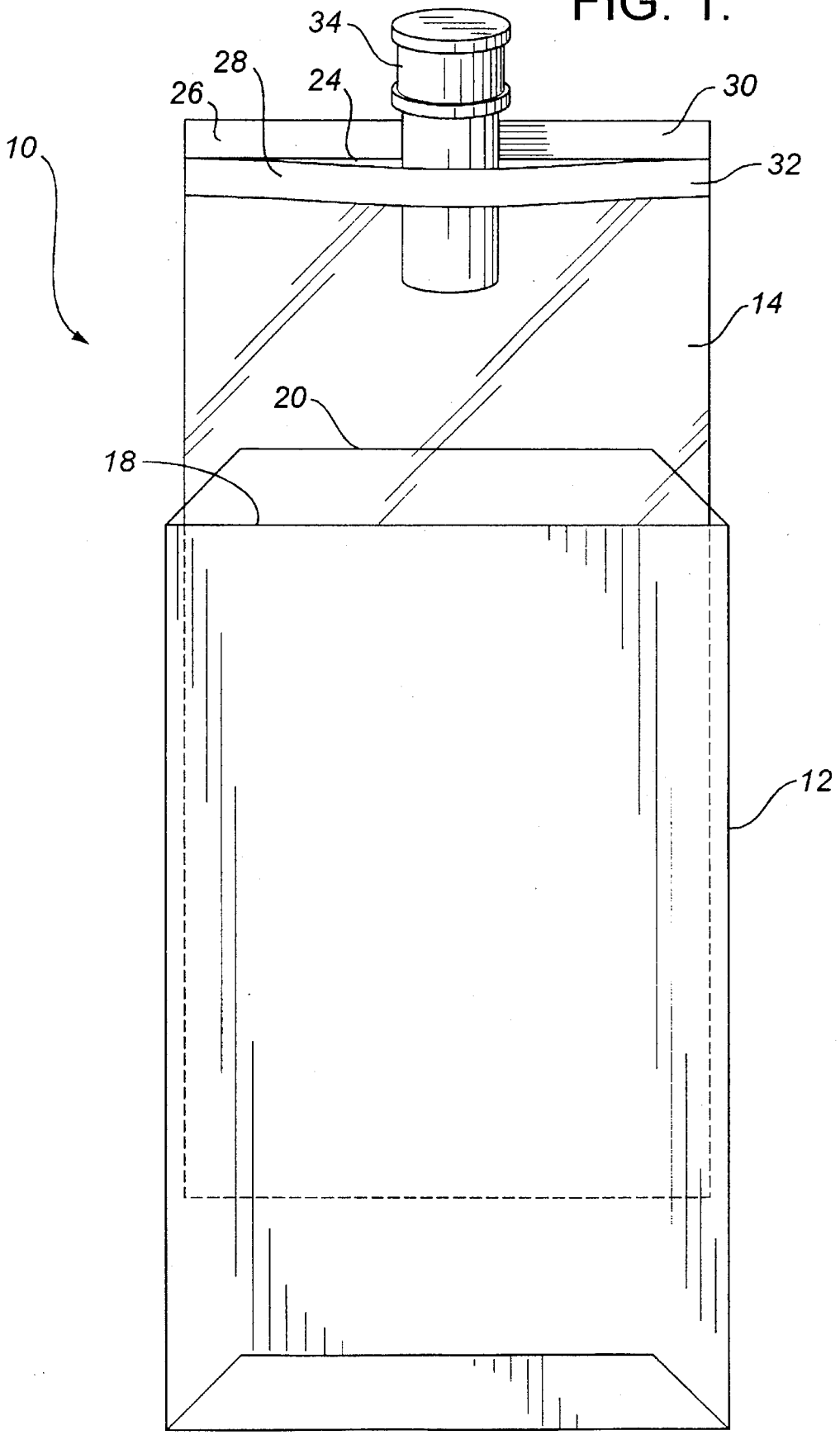
FIG. 1 is a side elevation view of the components of a pressure vessel constructed in accordance with the teachings of the present invention.

The preferred embodiment, a pressure vessel generally identified by reference numeral 10, will now be described with reference to FIGS. 1 through 4.

Figure 2:
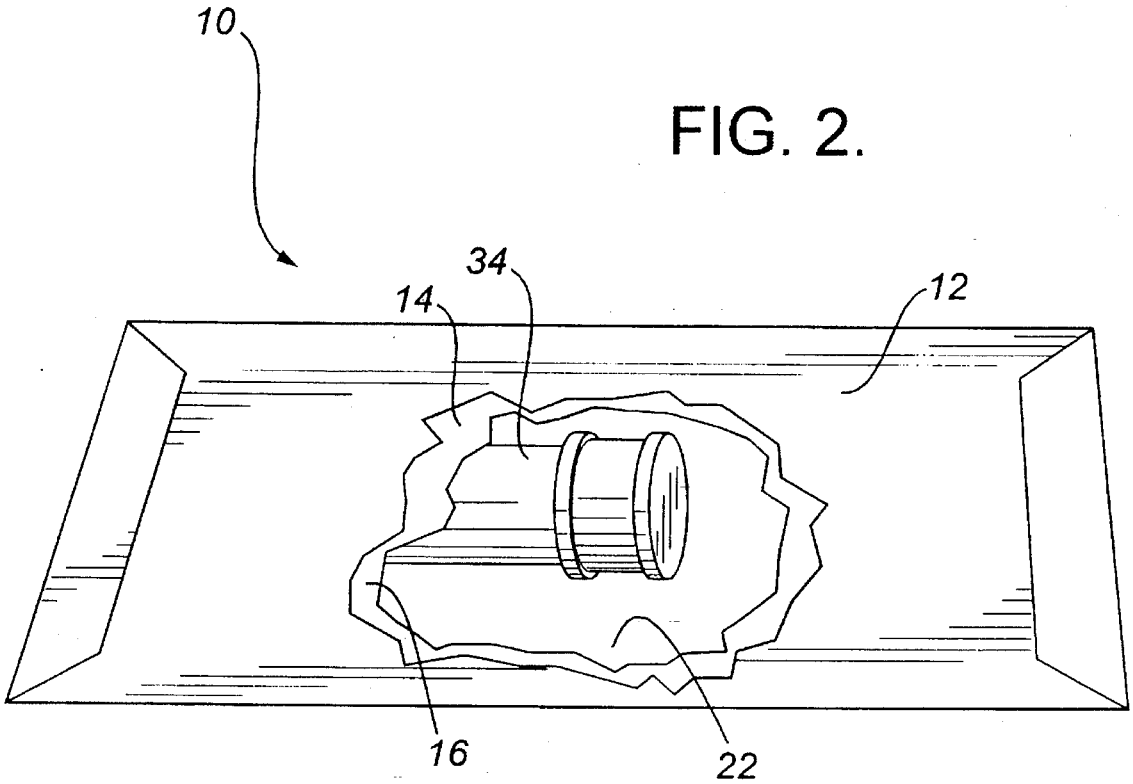
FIG. 2 is a partially cut away perspective view of a pressure vessel constructed in accordance with the teachings of the present invention, out of the components illustrated in FIG. 1.
Figure 4:
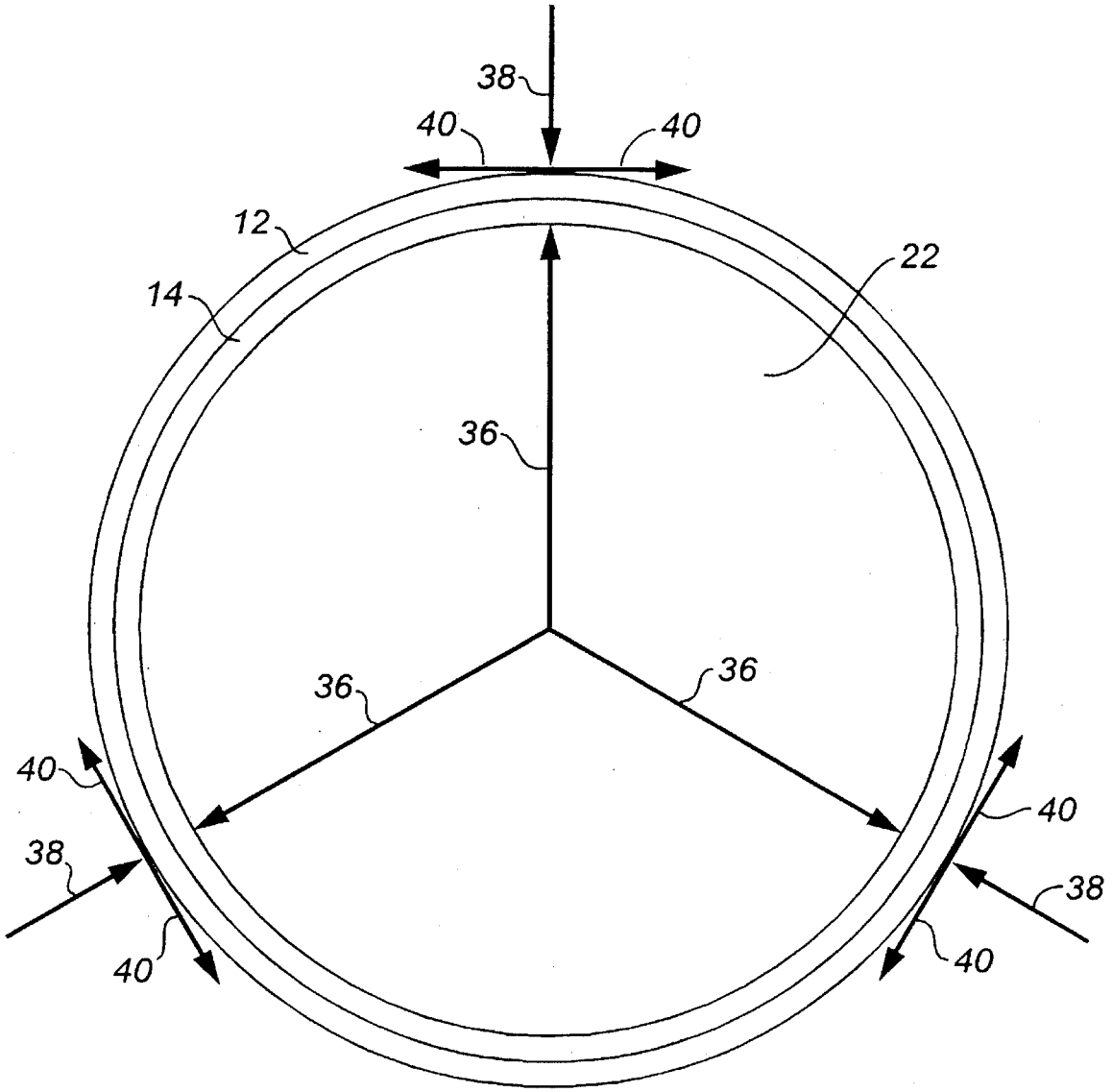
FIG. 4 is a section view taken along section lines 4—4 of FIG. 3.

Referring to FIG. 1, pressure vessel 10 has two primary components, a containment envelope 12 and an inner bladder 14. Containment envelope 12 is preferably constructed of a spun bonded olefin material, which is sold by Dupont Canada Inc. under the Trademark TYVEK. The particular material out of which containment envelope 12 is made is not as important as the properties that containment envelope 12 must possess. Containment envelope 12 must be flexible so that it can conform to the shape of inner bladder 14. It must remain dimensionally stable at the maximum intended pressure differential so that it effectively confines inner bladder 14. It must be air permeable and liquid permeable, as no fluid barrier can be permitted between containment envelope 12 and inner bladder 14. These same properties exist in woven stainless steel or Kevlar (trademark), such material is only cost effective for applications in which high containment strength is required. Referring to FIG. 2, containment envelope 12 has an interior cavity 16. Referring to FIG. 1, containment envelope 12 has an access opening 18 into interior cavity 16 which is closed by a closure flap 20. Inner bladder 14 is preferably constructed of a polymer plastic material. There are a number of polymer plastic bags commercially available that have built in sealable closures. The particular material out of which inner bladder 14 is made is not as important as the properties that inner bladder 14 must possess. Inner bladder 14 must be flexible and air tight, so that inner bladder 14 will expand under pressure in a fashion similar to a balloon. Inner bladder 14 must be liquid impervious so as to confine leakage from any dangerous liquids contained therein. These same properties exist in a rubber bladder, such material is only cost effective for applications in which high containment strength is required. Referring to FIG. 2, inner bladder 14 has an interior cavity 22. Referring to FIG. 1, an access opening 24 is provided into interior cavity 22. Access opening 24 is sealed by a closure flap 26. The particular inner bladder 14 illustrated is a commercially available polymer plastic bag with a sealed closure. The polymer plastic bag comes with adhesive (not shown) on both closure flap 26 and along a peripheral edge 28 of access opening 24. Backer strips 30 and 32, respectively, cover these adhesive areas. Backer strips 30 and 32 are removed to enable closure flap 26 to be sealed along peripheral edge 28. Referring to FIG. 2, there is illustrated the manner in which inner bladder 14 is disposed within interior cavity 16 of containment envelope 12. Referring to FIG. 4, for reasons that will be more fully explained in relation to the method of use it is important that inner bladder 14 in a fully expanded condition outside of containment envelope 12 be larger than interior cavity 16 of containment envelope 12.

Figure 3:
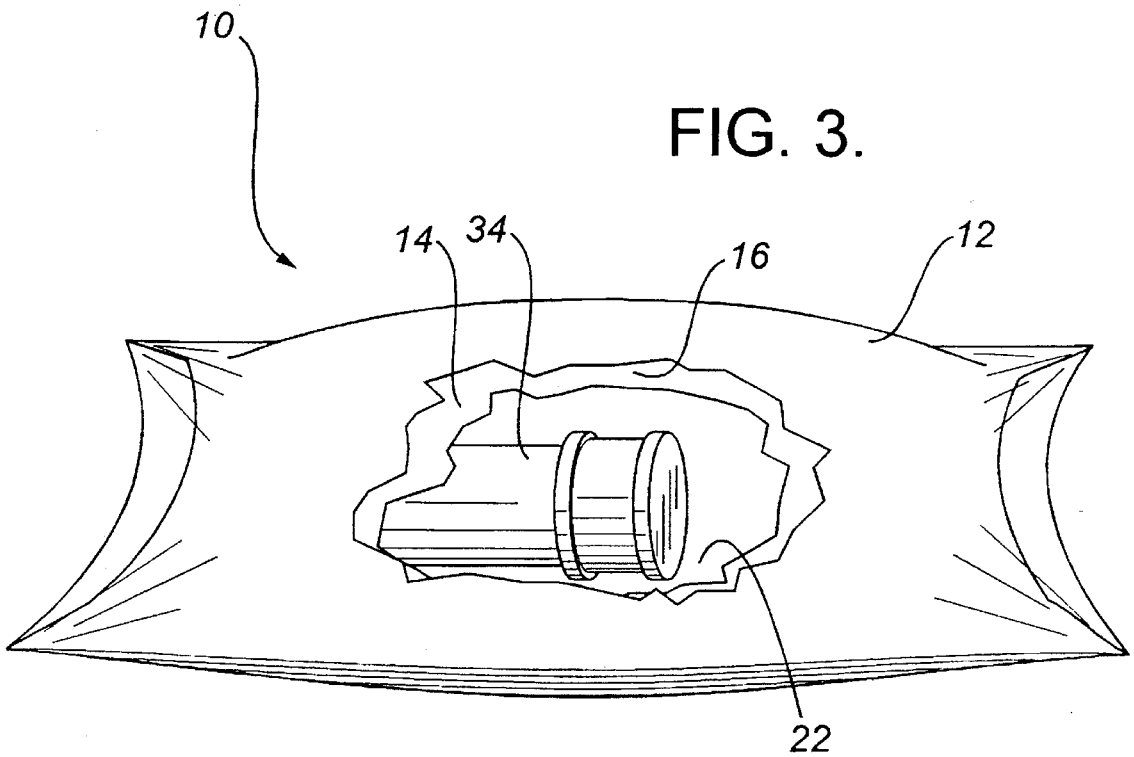
FIG. 3 is a partially cut away perspective view of the pressure vessel illustrated in FIG. 2, under a pressure differential.

The method of use of pressure vessel 10 will now be described with reference to FIGS. 1 through 4. Pressure vessel 10 is intended to maintain pressure containment on dangerous goods, in this case a diagnostic specimen 34. Firstly, place diagnostic specimen 34 into interior cavity 22 of flexible, air tight, liquid impervious, inner bladder 14, as illustrated in FIG. 1. Then, seal access opening 24 into interior cavity 22 with closure flap 26. Secondly, place inner bladder 14 into interior cavity 16 of flexible, air permeable, liquid permeable, containment envelope 12, as illustrated in FIG. 2. It is important that interior cavity 16 of containment envelope is smaller than inner bladder 14, when inner bladder is in a fully expanded condition outside of containment envelope 12, for the reasons that will hereinafter be described. Access opening 18 into interior cavity 16 is then closed with closure flap 20. Referring to FIG. 3, it is to be noted that when placed under pressure inner bladder 14 expands like a balloon to the extent allowed by containment envelope 12. Referring to FIG. 4, there is illustrated the various forces that are acting upon pressure vessel 10. An outward force created by internal pressure is represented by arrows 36. An inward force created by external pressure and confinement by containment envelope 12 is represented by arrows 38. Tensile forces acting upon containment envelope 12 are represented by opposed arrows 40. It is to be noted that the outward force 36 caused by internal pressure compresses inner bladder 14 against containment envelope 12. It is to be noted that containment envelope 12, being flexible, conforms to the shape of inner bladder 14. This removes any tensile strain upon inner bladder 14; tensile strain that would unavoidably be present if containment envelope was rigid. It is to be noted that containment envelope 12 is placed in tension, as illustrated by arrows 40. For this reason it is important that the material from which containment envelope 12 is made be suitable for the intended application. It must have the tensile strength to remain dimensionally stable at the maximum intended pressure differential.

It will be apparent to one skilled in the art that the present invention has application beyond the field of pressure vessels used for the transportation of dangerous goods. The teachings of the present invention has implications for any application in which it is necessary to contain pressure while meeting practical shipping limitations. For example, it is possible to construct large foldable and readily transportable storage tanks for the containment of liquids or gases at remote locations. Although such storage tanks may be huge when set up for use, they may be shipped in a collapsed condition that is comparatively small. It will also be apparent to one skilled in the art that modifications may be made to the illustrated embodiment without departing from the spirit and scope of the invention as defined by the claims.

The embodiments of the invention in which an exclusive property or privilege is claimed are as follows:

1. A pressure vessel, comprising:

a flexible, air permeable, liquid permeable, containment envelope having an interior cavity and an access opening closed by a closure, the closure remaining sealed and the containment envelope remaining dimensionally stable at a maximum intended pressure differential; and a separate, flexible, air tight, liquid impervious, inner bladder having an interior cavity and an access opening to receive an article sealed by an air impervious closure, the inner bladder being disposed within the interior cavity of the containment envelope in an unexpanded state, the inner bladder in a fully expanded condition outside of the containment envelope being larger than the interior cavity of the containment envelope such that when the inner bladder within the interior cavity of the containment envelope with internal pressure exceeding external pressure thereby creating a pressure differential, the internal pressure acts upon the inner bladder to place the inner bladder in compression within the interior cavity of the containment envelope while placing the containment envelope in tension.

2. The pressure vessel as defined in claim 1, wherein the containment envelope is of spun bonded olefin material.

3. The pressure vessel as defined in claim 1, wherein the inner bladder is a sealable polymer plastic bag.

4. A pressure vessel, comprising:

a flexible, air permeable, liquid permeable, spun bonded olefin containment envelope having an interior cavity and an access opening closed by a closure, the closure remaining sealed and the containment envelope remaining dimensionally stable at a maximum intended pressure differential; and a separate, flexible, air tight, liquid impervious, polymer plastic inner bladder having an interior cavity and an access opening to receive an article sealed by an air impervious closure, the inner bladder being disposed within the interior cavity of the containment envelope in an unexpanded state, the inner bladder in a fully expanded condition outside of the containment envelope being larger than the interior cavity of the containment envelope such that when the inner bladder within the interior cavity of the containment envelope with internal pressure exceeding external pressure thereby creating a pressure differential, the internal pressure acts upon the inner bladder to place the inner bladder in compression within the interior cavity of the containment envelope while placing the containment envelope in tension.

5. A method of maintaining pressure containment on dangerous goods, such as diagnostic specimens, comprising the steps of:

firstly, placing dangerous goods into an interior cavity of a flexible, air tight, liquid impervious, inner bladder, and sealing an access opening into the interior cavity with an air impervious closure; and secondly, placing the inner bladder into an interior cavity of a flexible, air permeable, liquid permeable, containment envelope and closing an access opening into the interior cavity with a closure in an unexpanded state, the closure remaining sealed and the containment envelope remaining dimensionally stable at a maximum intended pressure differential and the interior cavity of the containment envelope being smaller than the inner bladder in a fully expanded condition outside of the containment envelope, such that when the inner bladder within the interior cavity of the containment envelope with internal pressure exceeding external pressure thereby creating a pressure differential internal pressure acting upon the inner bladder places the inner bladder in compression within the interior cavity of the containment envelope while placing the containment envelope in tension.

* * * * *